United States Patent [19]

Bisconti

[11] Patent Number: 4,905,389

[45] Date of Patent: Mar. 6, 1990

[54] MULTIPLE ASPECT PHOTO FRAMES

[76] Inventor: Vincent Bisconti, 25 Lindner Pl., Malverne, N.Y. 11565

[21] Appl. No.: 234,612

[22] Filed: Aug. 22, 1988

[30] Foreign Application Priority Data

Apr. 22, 1988 [IT] Italy ..... 20305 A/88

[51] Int. Cl.[4] ..... A47G 1/06; G09F 1/12

[52] U.S. Cl. ..... 40/152.1; 40/158.1

[58] Field of Search ..... 40/152.1, 152, 158.1, 40/155, 156, 615, 611; 26/311

[56] References Cited

U.S. PATENT DOCUMENTS

| | | | |
|---|---|---|---|
| D. 280,150 | 8/1985 | Pargman | D6/311 |
| 547,377 | 10/1895 | Gillbee | 40/152.1 |
| 2,737,742 | 3/1956 | Leigh | 40/155 |
| 2,919,512 | 1/1960 | McDonald | 40/152.1 |
| 3,540,146 | 11/1970 | Watkins | 40/152.1 |
| 3,965,600 | 6/1976 | Paskerian | 40/152.1 |
| 4,207,694 | 6/1980 | Dickey | 40/152.1 |

FOREIGN PATENT DOCUMENTS

| | | | |
|---|---|---|---|
| 691440 | 7/1930 | France | 40/152.1 |
| 456875 | 7/1968 | Switzerland | 40/152.1 |
| 653060 | 5/1951 | United Kingdom | 40/615 |
| 1073651 | 6/1967 | United Kingdom | 40/152.1 |

*Primary Examiner*—Kenneth J. Dorner
*Assistant Examiner*—J. Hakomaki
*Attorney, Agent, or Firm*—Darby & Darby

[57] ABSTRACT

A photograph frame which can be utilized to hang on the wall or to rest on a flat surface either horizontally or vertically by means of a rear panel with a support flap which can be slid under a channel to present a planar panel or withdrawn from the channel to provide a support.

5 Claims, 3 Drawing Sheets

1
2
10
3
9
8
7
6
5
11
4

MULTIPLE ASPECT PHOTO FRAMES

BACKGROUND OF THE INVENTION

The present invention relates to a multiple aspect photo frame having the characteristic of including a transformable rear panel which permits it to be hung on a wall or placed on a table in either a vertical or horizontal position.

DESCRIPTION OF RELATED ART

It is well-known that all photo frames can be used as wall pictures or as table decorations.

Therefore they have either a smooth rear panel with a hook for wall hanging or a hinged external element which can be pulled out so that the frame can rest on a horizontal surface.

In prior art systems, rear panels of the frames were provided with a hook for hanging on a wall or with a support hinged to the rear panel and adapted to be swung outwardly to support the frame on a surface. However, when hung on a wall, the support prevented the frame from lying flat against the wall thus detracting from an aesthetic appearance and, in some cases, causing the hook to disengage from the frame hanger.

SUMMARY OF THE INVENTION

The present invention on the other hand provides for the production of a photo frame with a transformable closing panel slotted into a special border attached to the frame, so that the support flap disappears completely when the frame is hung on the wall.

The said panel is in practice made up of two coupled flat components which form the thickness o the back closing element.

The outer one of these two components has a triangular sector which can be folded and which forms the horizontal or vertical support foot on the table.

This transformation does not require any type of tool since the only operation required is to partially withdraw the panel until the triangular section is freed from the perimetral guide and then to open it out in the direction of the surface on which it is to rest.

It must also be noted that the aforesaid fold is obtained without the help of a hinge but by means of a crease in the rigid part of the panel, which is maintained connected with the panel by the external facing of fabric or similar material which has been made adhesive.

From the description it is obvious that this invention is a practical and logical solution which permits the photo frames in question to be either hung on the wall or to be placed on a surface without anything protruding from the rear panel.

BRIEF DESCRIPTION OF THE DRAWINGS

These and other characteristics will be made more evident in the detailed description which follows, provided purely as a non-limiting example of the scope of the invention, with the aid of the various figures in the attached illustrative drawing, in which.

DESCRIPTION OF THE PREFERRED EMBODIMENT

Figure 1:
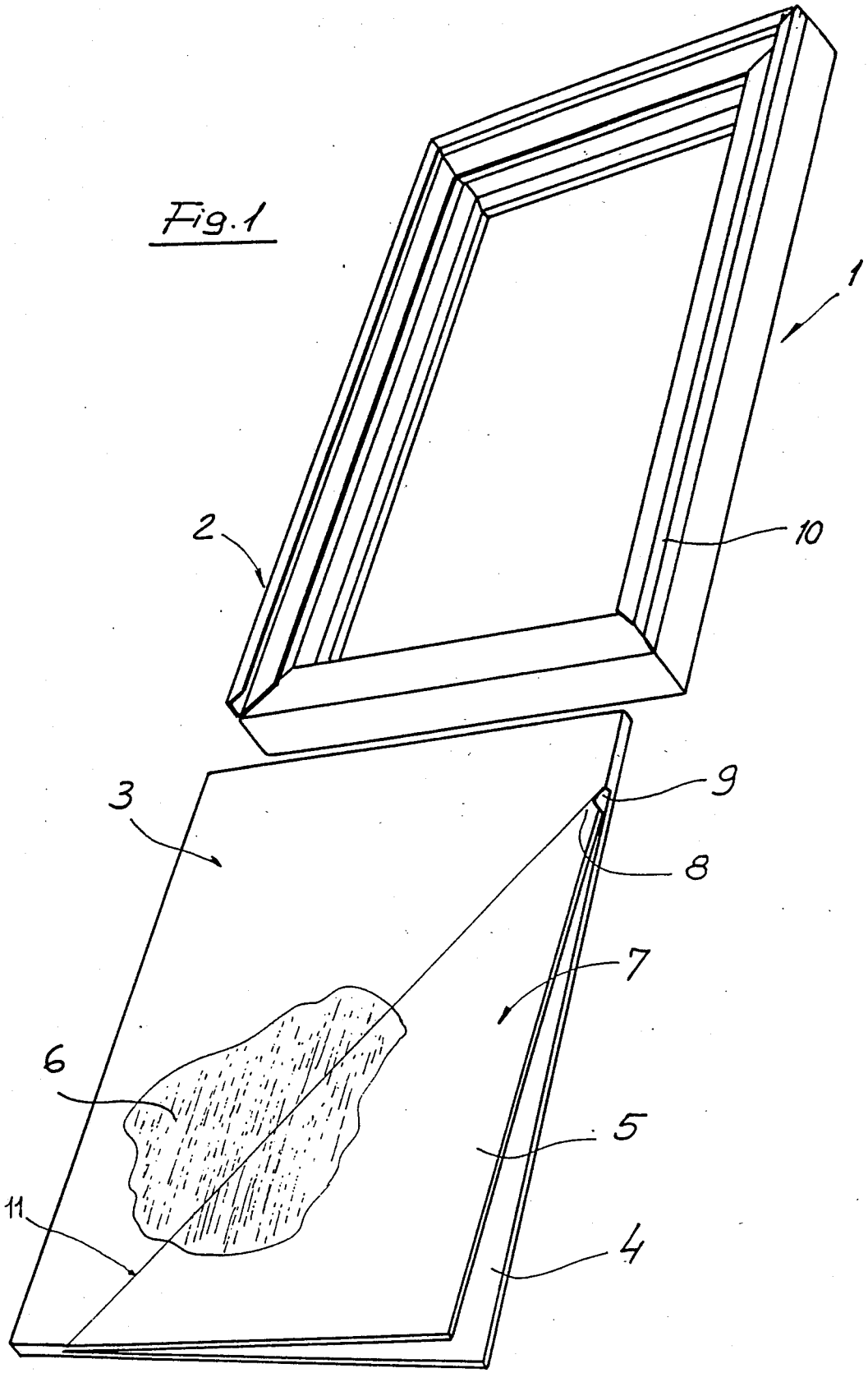
FIG. 1 shows a rear perspective exploded view of the photo frame, provided with the transformable rear panel in question freed from the fixed guide of the frame.

Referring to FIG. 1, the invention in question includes a frame 1 provided with a perimetral strip or channel 2 fixed along three sides of the frame and a closing panel 3 adapted to be slidingly received in the strip.

This panel 3 is formed of two coupled panels or sheet-shaped components 4 and 5 faced with canvas 6 or a similar material which has been covered with an adhesive to stick to the sheets 4 and 5.

The external component 5 includes a triangular flap or section 7 creased along the diagonal fold line 11 and kept together by the external facing which also acts as a continuous planar hinge thereby eliminating any protrusions on the back panel. The diagonal fold line 11 does not coincide with the geometrical diagonal of the panel 3 but is parallel to it and displaced with respect to it by a distance which is appropriate and sufficient to create the flap 7.

This section can, in practice, be folded outward and oriented in both a horizontal and vertical position to act as a support foot on a table. Alternatively, it can remain flat against the counterpanel 4 in order to hang the frame on the wall.

Figure 2:
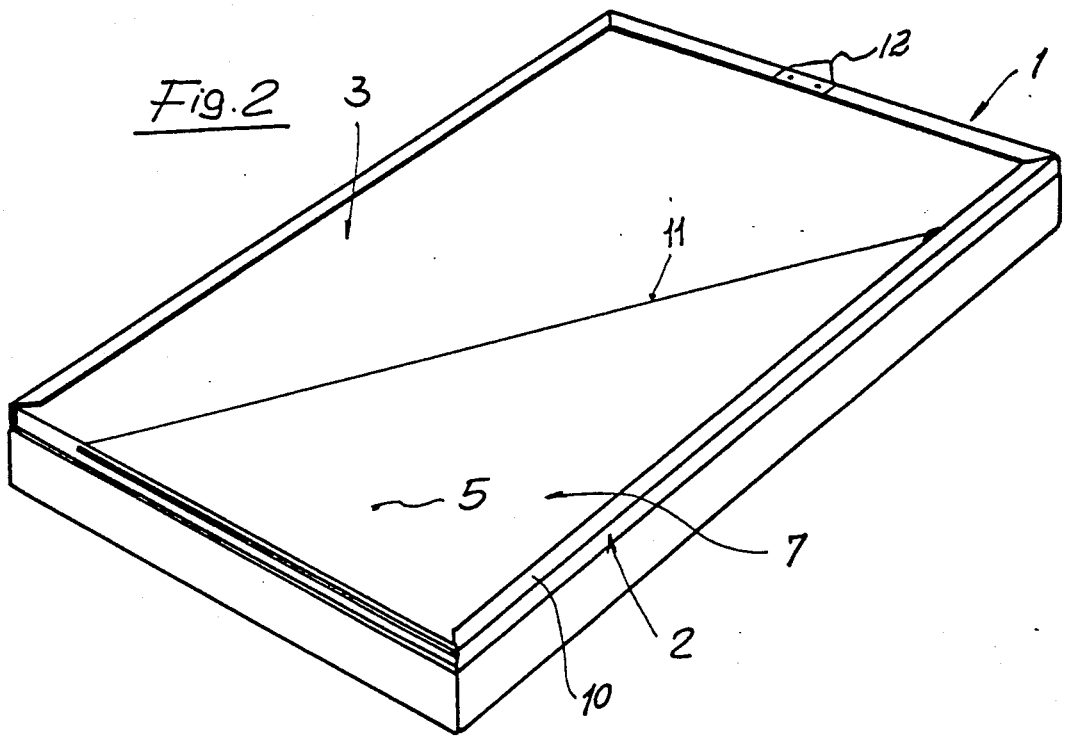
FIG. 2 shows a rear perspective view of the aforesaid photo frame with the panel completely closed, when the photo frame is hung on the wall.
Figure 3:
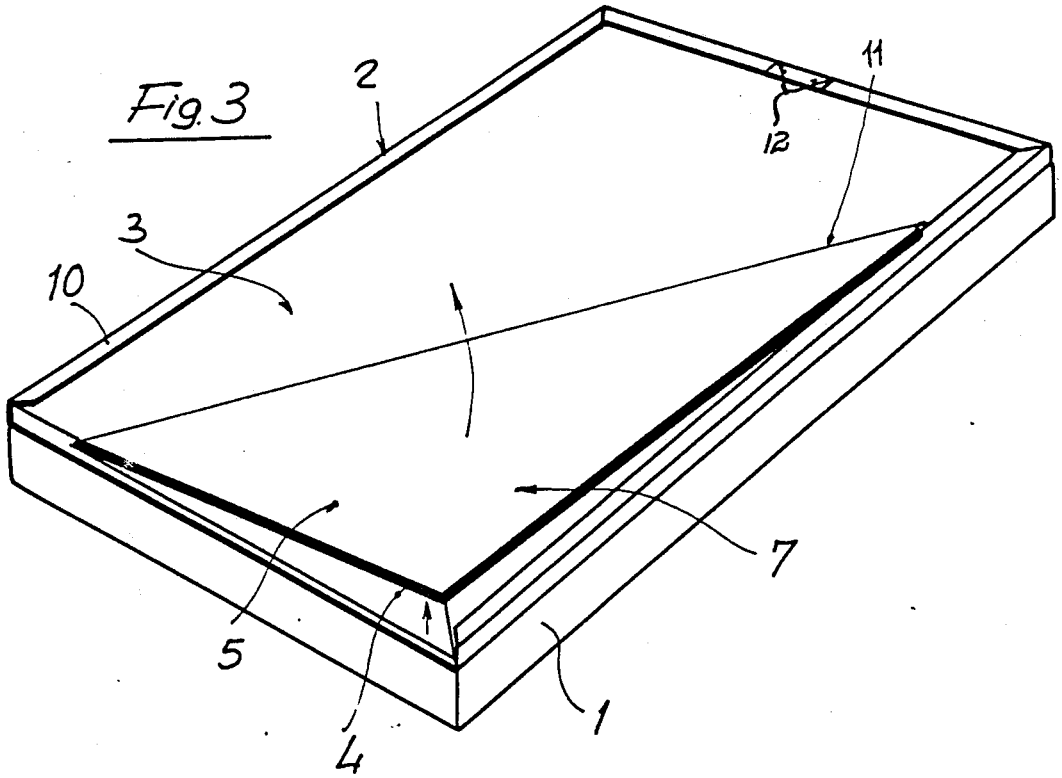
FIG. 3 shows a rear perspective view of the photo frame with the triangular support element bent outwards and freed from the retaining guide.
Figure 4:
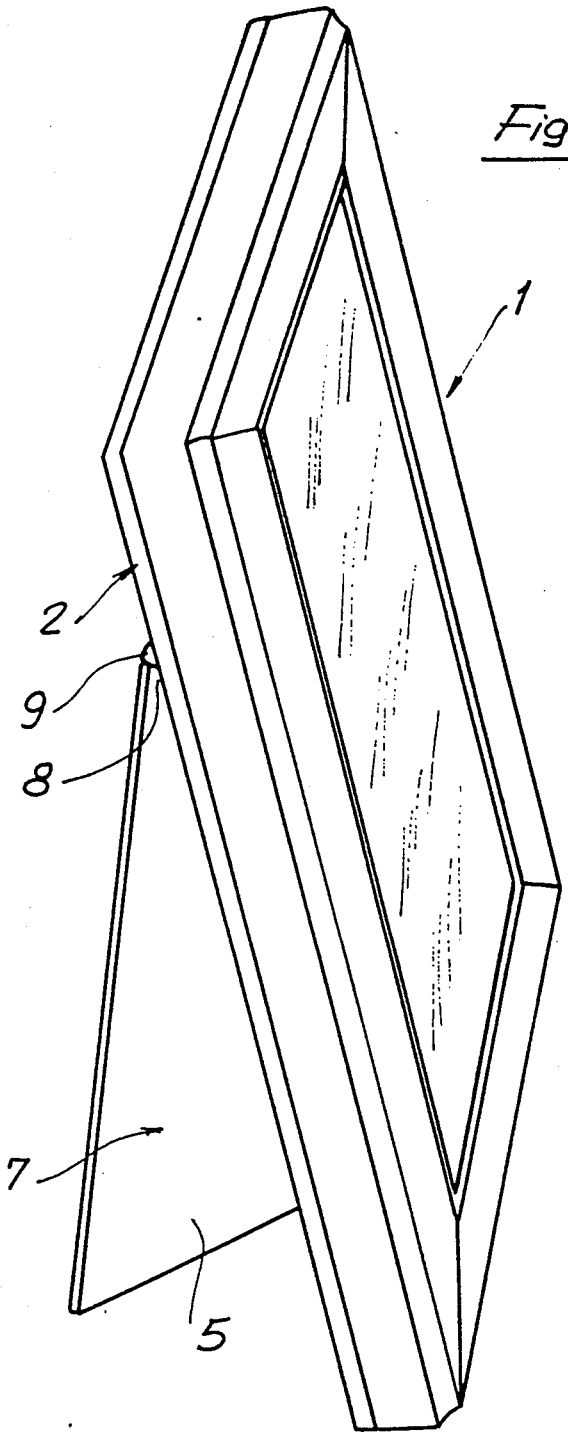
FIG. 4 shows a view of the photo frame resting on a table.

As shown in FIGS. 2, 3 and 4, in practice the rear panel 3 can be kept completely inserted in the channel or perimetral strip 2 or partially withdrawn to free the folding portion 7 outwards for the transformation for use on a table.

It must also be noted that the apex 8 of the folding triangular section has a small amount of material removed to form a notch 9 of a size equal to the dimensions of the outermost wall or external wing 10 of the guide strip 2, to permit withdrawal for bending.

Since the foldable flap is obtained from two perimetral sides of the panel corresponding to the external profile of the frame, it is obvious hat it enables the photo frame to be positioned either vertically or horizontally on a surface on either the shorter side or the longer side.

In operation, if the frame is to be hung on the wall, the panels 4, 5 are left within the channel 2 as shown in FIG. 2. That is, the edge 10 of the panel 2 overlies the edge of the flap 7 so that the entire panel presents a flat surface. The frame may then be hung on a wall by engaging the upper hook 12 with an appropriate hanger.

On the other hand, if the frame is to be supported on a table, the panels are withdrawn until the notch 9 clears the channel 2. The lap 7 is then opened along the fold line 11 and the panels are then pushed back into the channel. Hence, the flap 7 will remain free to support the frame in either a vertical or horizontal position.

Finally, it must be emphasized that the present embodiment illustrates the invention without in any way limiting the scope thereof and that numerous modifications, additions, variations or replacements of elements can be made to this invention without in any way altering its spirit or scope and while still remaining within its scope of protection as defined in the claims attached hereto.

What is claimed:

1. A photograph frame having a pair of side members interconnected by a pair of end members, a channel extending along at least said side members, a first and second panel connected together in superposed alignment, a flap portion on said first panel mounted to be pivotably movable between open and closed positions, said flap protruding from the plane of said first panel in the open position and lying in said plane and being superposed on said second panel when in the closed position, said first and second panels having edges and being dimensioned so that said edges are slidably received in superposed relationship within said channel, and said flap has an edge colinear with an edge of said superposed panels and received within said channel when said flap is in the closed position, said flap having a diagonal fold line beginning at a side edge from a point spaced below the top edge of said first panel and extending across said first panel to a point intermediate said side members, and a notch on said flap proximate said fold line beginning.

2. A frame as in claim 1, in which said channel also extends along one of said end members.

3. A frame as in claim 1, in which said panel is provided with a diagonally extending fold line defining said flap, and a support member connected to the remainder of said panel and coextensive with said panel and flap.

4. A frame as in claim 1, in which said flap and said panel are covered with a flexible material whereby said material provides a hinged connection between said panel and said flap.

5. A frame as in claim 1, in which said diagonal fold line is positioned parallel to and spaced from the geometric diagonal of said panel.

* * * * *